US005816011A

United States Patent [19]

Kuramoto

[11] Patent Number: 5,816,011

[45] Date of Patent: Oct. 6, 1998

[54] JOINT FITTING FOR UNIT BUILDING

[75] Inventor: Kikuzo Kuramoto, Funabashi, Japan

[73] Assignee: Nisso Sangyo Co., Ltd., Tokyo, Japan

[21] Appl. No.: 659,413

[22] Filed: Jun. 6, 1996

[30] Foreign Application Priority Data

Aug. 31, 1995 [JP] Japan ..... 7-246743

[51] Int. Cl.[6] ..... F16B 7/18

[52] U.S. Cl. ..... 52/655.1; 52/656.9; 403/207; 403/176

[58] Field of Search ..... 52/655.1, 656.9, 52/665, 653.2, 654.1; 403/207, 208, 176, 170

[56] References Cited

U.S. PATENT DOCUMENTS

| | | | |
|---|---|---|---|
| 3,513,606 | 5/1970 | Jones | 52/655.1 X |
| 3,864,051 | 2/1975 | Reid | 52/656.9 X |
| 4,271,654 | 6/1981 | Jungbluth | 52/655.1 X |
| 4,610,561 | 9/1986 | Cecchellero et al. | 52/655.1 X |
| 5,119,613 | 6/1992 | Atkinson et al. | 52/655.1 X |

FOREIGN PATENT DOCUMENTS 6-15784 1/1988 Japan .

*Primary Examiner*—Christopher Kent
*Assistant Examiner*—Yvonne Horton-Richardson
*Attorney, Agent, or Firm*—McGlew and Tuttle

[57] ABSTRACT

A joint fitting for use in a unit building provides a box-like support structure for respective ends of a column and beams to strengthen a connection or joint between the column and the beams, with a simple assembling work and low cost involved. In one preferred form, the metal fitting is used in a unit building including a plurality of unit blocks connected together in vertical, longitudinal and transverse directions and each composed of a rectangular tube-like column and at least two rectangular tube-like beams connected together. The joint fitting is composed of a substantially box-shaped metal frame member including at least one column engagement portion fittingly engageable with an end of at least one column, and at least two beam engagement portions fittingly engageable with respective ends of at least two beams.

9 Claims, 8 Drawing Sheets

JOINT FITTING FOR UNIT BUILDING

FIELD OF THE INVENTION

The present invention relates to a joint fitting for use in the construction of a frame of a unit building to hold together mating ends of columns and beams in fitting engagement before the ends are connected together by welding and the like at the joint.

BACKGROUND OF THE INVENTION

A unit building composed of an assembly of columns, beams, wall members and floor members includes brackets provided mainly on those columns forming a frame of the unit building, so that the beams and wall members are connected to and held on the columns via the brackets.

More particularly, for example, in a unit building disclosed in Japanese Patent Publication No. 6-15784, brackets are attached by welding to steel columns, and beams are assembled with the steel columns with their ends bolted or welded to the brackets on the columns.

However, since the conventional unit building usually has a steel rigid frame structure, the beams are subjected to a great load acting on connections or joints at the respective brackets. The brackets at the joints between the columns and the beams should, therefore, be strong enough to sustain the great load, and the joints should be improved in dimensional accuracy. This will require an on-site reinforcement work, bringing about a low assembling efficiency and an increased assembling cost.

SUMMARY OF THE INVENTION

With the foregoing drawbacks in view, it is an object of the present invention to provide a joint fitting for use in a unit building and capable of providing a box-like support structure for respective ends of a column and beams to strengthen a connection or joint between the column and the beams, with simple assembling work and low cost.

To attain the foregoing object, the present invention provides a joint fitting for a unit building including a plurality of unit blocks connected together in vertical, longitudinal and transverse directions and each composed of a rectangular tube-like column and at least two rectangular tube-like beams connected together. The joint fitting comprises a substantially box-shaped metal frame member including at least one column engagement portion fittingly engageable with and into an end of at least one column, and at least two beam engagement portions fittingly engageable with and into respective ends of at least two beams.

It is preferable that the beam engagement portions are disposed on two sides of the box-shaped metal frame member facing in different directions to form an angular arrangement perpendicular to each other.

In another preferred form, the number of the beam engagement portions is three, and three beam engagement portions are disposed on opposite sides of the box-shaped metal frame member and a side of the metal frame member facing in a direction perpendicular to the opposite sides, respectively.

The metal frame member preferably includes a portion having a brace anchor hole for anchoring one end of a brace to the metal frame member.

It is further preferable that the metal frame member includes a portion having a bolt hole for joining two adjacent ones of the metal frame member.

Preferably, the column engagement portion is composed of a rectangular metal plate, and the beam engagement portions are each composed of a rectangular metal plate and one or more rectangular stepped portions formed on an outside surface of the rectangular metal plate.

The metal frame member preferably has a substantially box-like shape formed jointly by an upper plate, a lower plate, and a vertical plate disposed between the upper and lower plates. Each of the upper plate and the vertical plate has at least one bolt hole. The upper plate further has at least one access opening available during the assembling process of the unit building, and the upper and lower plates define therebetween an access opening located at a desired position of a corner of said angular arrangements and available during the assembling process of the unit building.

The above and other objects, features and advantages of the present invention will become manifest to those versed in the art upon making reference to the detailed description and the accompanying sheets of drawings in which preferred structural embodiments of the invention are shown in by way of illustrative example.

DESCRIPTION OF THE PREFERRED EMBODIMENTS

Certain preferred embodiments of the present invention will be described below in greater detail with reference to the accompanying drawings.

Figure 1:
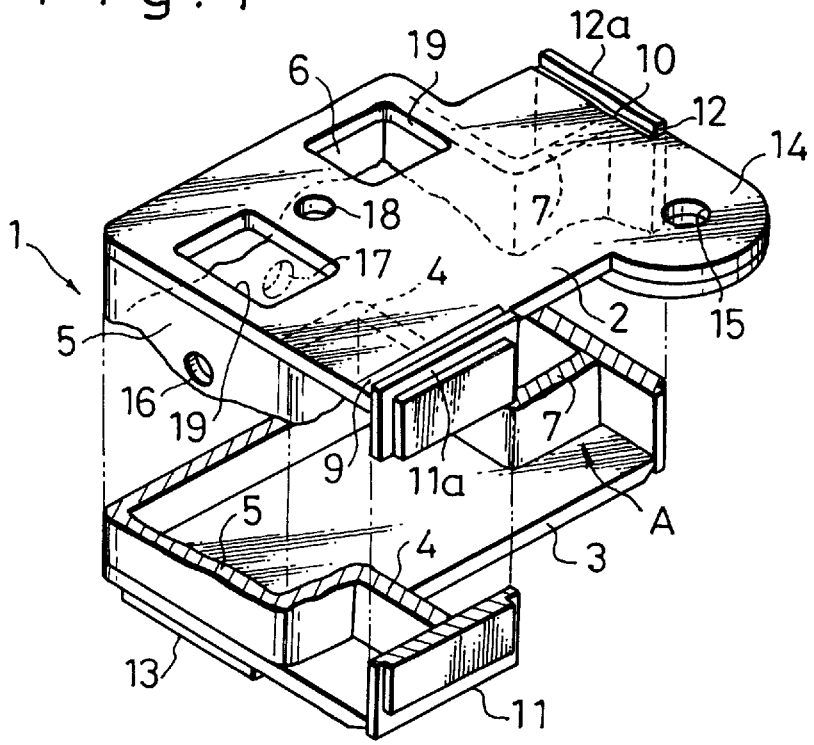
FIG. 1 is a perspective view of a joint fitting for use in a unit building according to one embodiment of the present invention.
Figure 2:
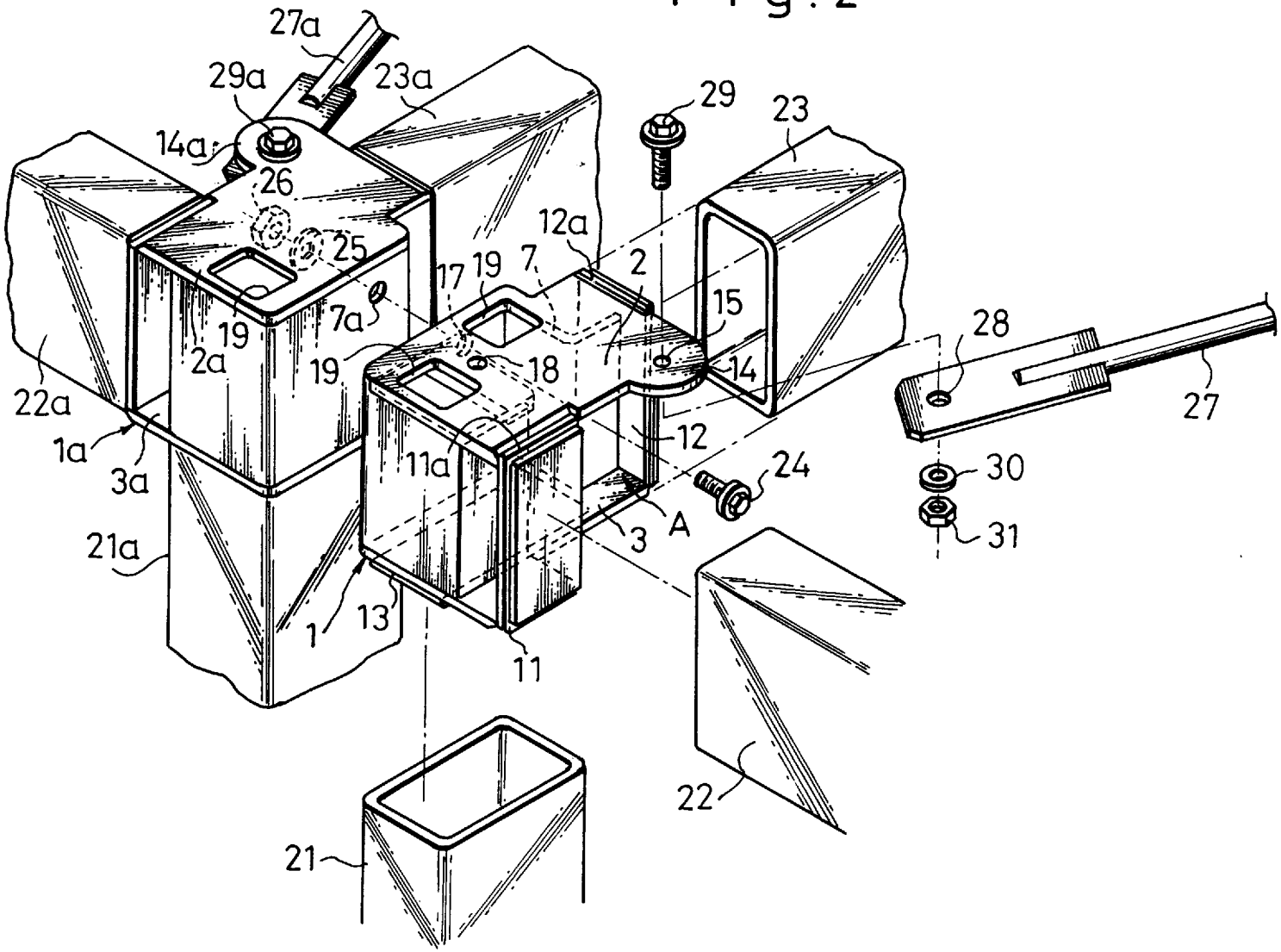
FIG. 2 is an exploded perspective view illustrative of the manner in which the joint fitting of FIG. 1 is used in practice.
Figure 3:
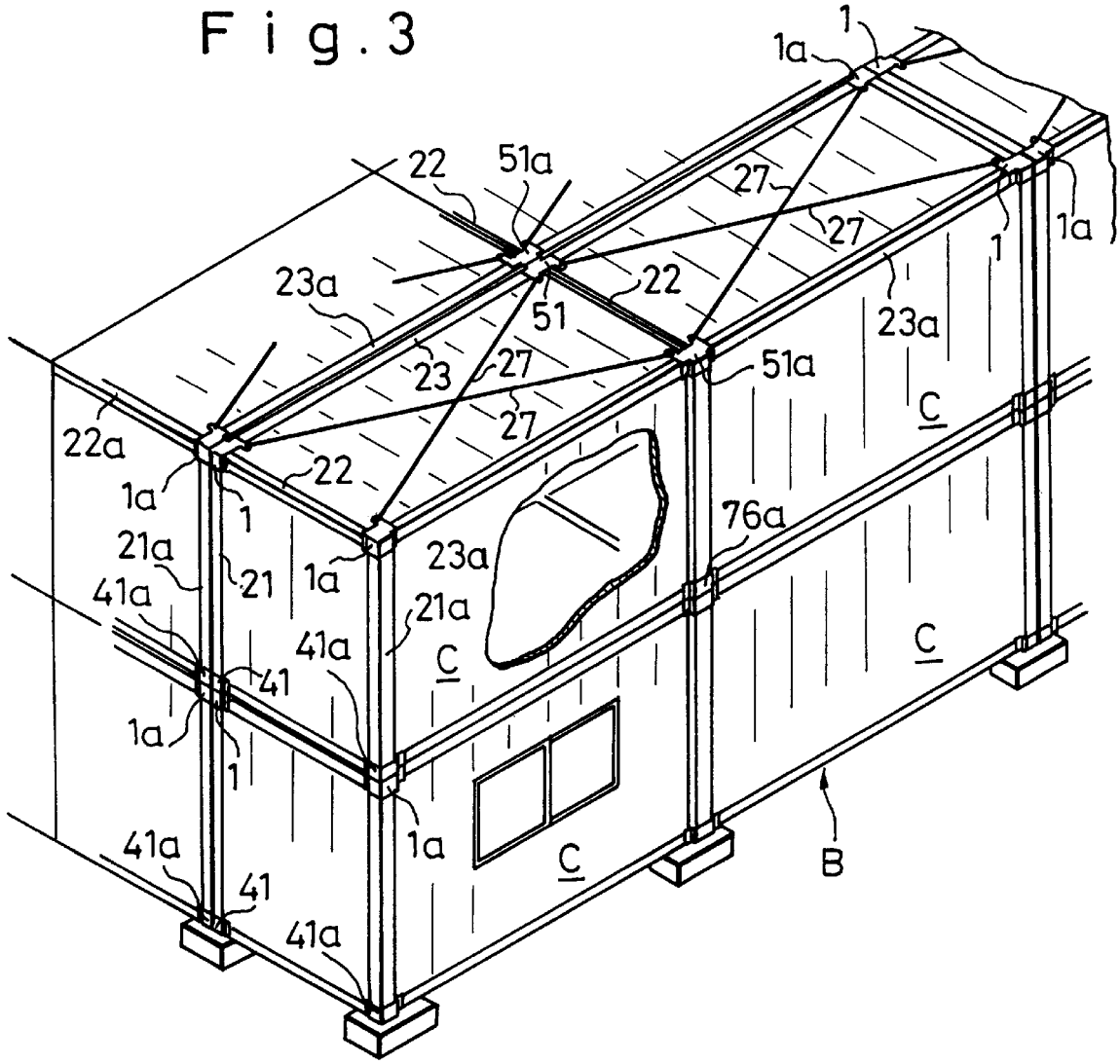
FIG. 3 is a perspective view showing the general construction of a unit building in which the joint fitting of FIG. 1 is incorporated.

Referring now to FIG. 1, there is shown a joint fitting according to a first embodiment of the present invention, the joint fitting being used as a part of a unit building shown in FIGS. 2 and 3.

In FIGS. 1 and 2, reference numeral 1 denotes a substantially box-shaped metal frame member shop-fabricated from metal plates, such as steel plates. The metal frame member 1 constitutes a body of the joint fitting and is composed of an upper or first plate 2 and a lower or second plate 3 joined together by welding and the like, with a vertical or joining plate 4–7 disposed therebetween. The vertical plate is composed of an angled strip 4, a side strip 5, a back strip 6, and an angled strip 7.

The upper plate 2 has two recessed portions 9 and 10 along its two side edges located adjacent to the angled strips 4 and 7. Two beam engagement members 11 and 12 are attached by welding to the recessed portions 9, 10 and the corresponding side edges of the lower plate 3 so as to form beam engagement portions extending between the upper and lower plates 2, 3.

The beam engagement members 11, 12 are each composed of a metal plate having, on its outside surface, a stepped portion 11*a*, 12*a* for fitting engagement with a corresponding one of two adjacent beams located respectively in front of, and on the side of, the metal frame member 1. To this end, the stepped portions 11*a*, 12*a* are so shaped as to have a size and configuration which secures fitting engagement between the stepped portions 11*a*, 12*a* and one end of the corresponding beams having a rectangular tube-like construction as described later on.

Although the stepped portions 11*a*, 12*a* in the illustrated embodiment are composed of a single step, a multi-step structure composed of a plurality of stepped portions of different outside diameters disposed one above another may be employed to enable that a beam having a different inside diameter can be fitted with and into a selected one of the stepped portions of the corresponding beam engagement member 11, 12.

Each of the beam engagement members 11, 12 has an inside surface, a central portion of which is held in abutment with, and integrally joined by welding to, an edge of the corresponding angled strip 4, 7.

Reference numeral 13 denotes a rectangular plate-like column engagement member provided by cutting or welding on an outside surface of the lower plate 3. The column engagement member 13 serves as a column engagement portion and is so shaped as to have an adequate shape and size which is capable of securing fitting engagement between the column engagement member 13 and the upper end of a column disposed below the metal frame member 1.

Designated by 14 is a semicircular projection projecting from a portion of the upper plate 12. The projection 14 has formed therein a brace anchor hole 15 for locking or anchoring one end of a brace, for example, by means of a bolt-and-nut fastener.

Reference numerals 16, 17 and 18 denote bolt holes formed in the upper plate 2, the side strip 5 and the back strip 6, respectively, for receiving bolts when the metal frame member 1 and an adjacent metal frame member 1 are joined together by means of a bolt-and-nut fastener. Designated by 19 are a plurality of access holes formed in the upper plate 2 and used for receiving a tool and/or operator's fingers when the operator is achieving a fastener tightening work during the unit building constructing process. Similarly, the upper and lower plates 2, 3 define therebetween an access opening A opening at the front side of the metal frame member 1 and available for receiving a tool and/or operator's fingers during the assembling process of the unit building.

In assembling a unit building B, the joint fitting of the foregoing construction is used in such a manner as shown in FIG. 2 and 3, in which instance a rectangular tube-like column 21 and two rectangular tube-like beams 22 and 23 are provided, and then an upper end of the column 21 is fitted around an outer peripheral surface of the column engagement member 13, and one end of each of the beams 22, 23 is fitted around the stepped portion 11*a*, 12*a* of a corresponding one of the beam engagement members 11, 12.

Subsequently, the column 21 and the beams 22, 23 are integrally connected by welding to the column engagement member 13 and the beam, engagement members 11, 12, respectively.

As shown in FIG. 2, a metal frame member la which is symmetrical in shape with the metal frame member 1 is disposed at a corner of an adjacent block of the unit building B. The metal frame member 1 and the metal frame member 1*a* are connected together in the horizontal direction by means of a bolt 24 extending through the two aligned bolt holes 17, 17*a*, and a nut 26 tightly screwed onto the bolt 24 with a washer 25 disposed between the nut 26 and the metal frame member 1*a*.

Subsequently, a column 21*a* and two beams 22*a*, 22*b* are fitted with the metal frame member 1*a*, and after the column 21*a*, the beams 22*a*, 22*b* and the metal frame member 1*a* are integrally joined together by welding in the same manner as done with respect to the metal frame member 1.

The metal frame members 1 and 1*a* may be also disposed on an upper corner edge of another block C of the unit building B, as shown in FIG. 3, and they are connected with another pair of adjacent metal frame members 51*a*, 51, respectively, by a pair of diagonally extending braces 27.

The braces 27 are disposed above roof beams or binders of the block C and each have connection holes 28 at opposite ends. One of the braces 27 extending from the metal frame member 51*a* has an end underlapped with the projection 14 of the metal frame member 1 with the connection hole 28 vertically aligned with the brace anchor hole 15. A bolt 29 is inserted through the aligned holes 15, 28 and then a nut 30 is tightly screwed onto the bolt 29, with a washer 30 disposed between the nut 30 and the brace 27, so that the two diagonally opposed metal frame members 1 are tightly interconnected by the brace 27. The other brace 27 is connected to the adjacent metal frame member 1*a* to interconnect the two diagonally opposed metal frame members 1*a* and 51. With the braces 27 thus arranged, the block C is able to hold its rectangular shape.

Figure 4:
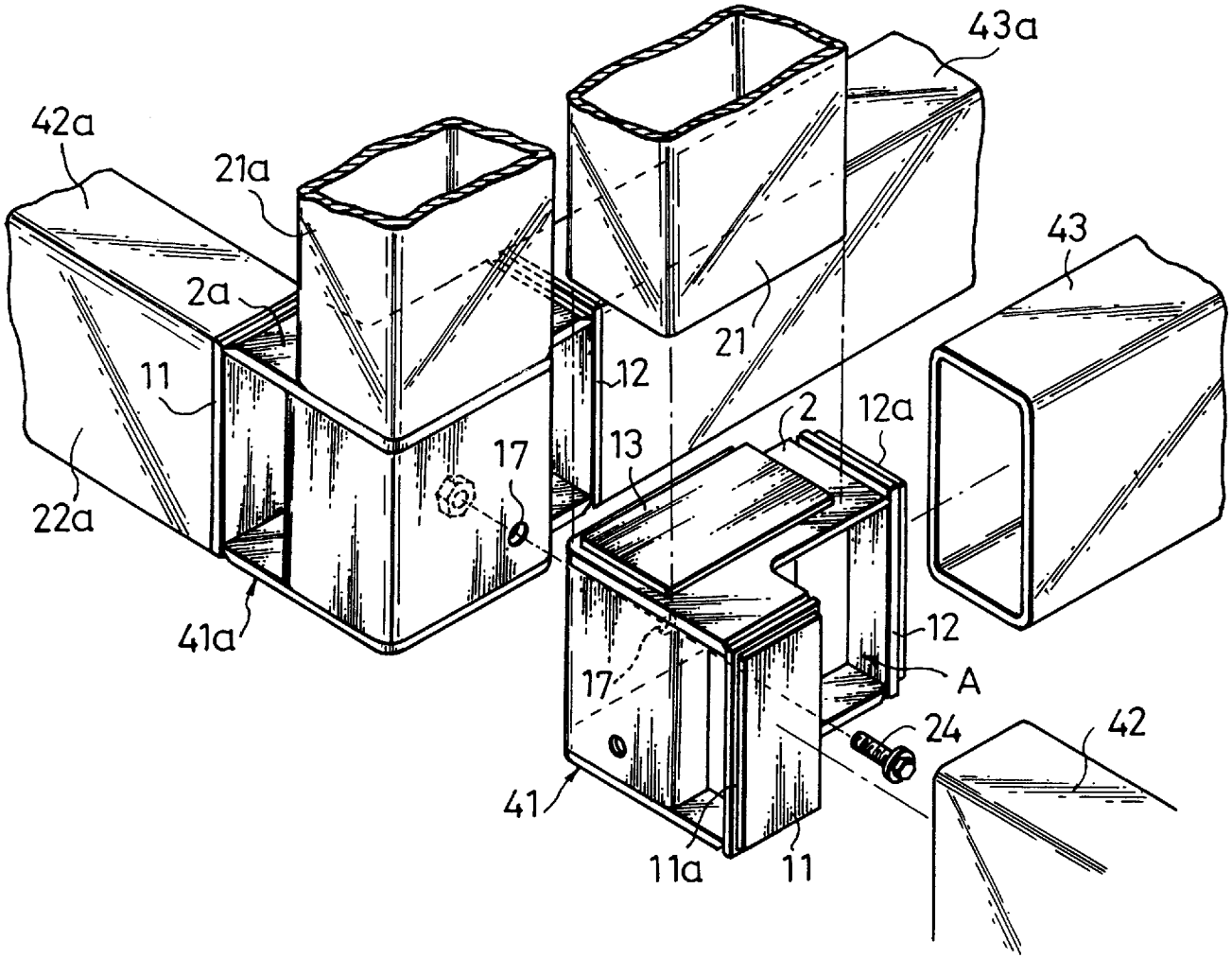
FIG. 4 is an exploded perspective view illustrative of the manner in which a joint fitting according to another embodiment of the present invention is used in practice.

FIG. 4 shows a pair of joint fittings according to another embodiment of the present invention. The joint fittings are composed of a pair of metal frame members 41 and 41*a* disposed in vertical confrontation to the metal frame members 1 and 1*a* with two columns 21, 21*a* disposed therebetween. The metal frame members 41, 41*a* are each engaged with the lower end of a corresponding one of the columns 21, 21*a* to hold the lower end, while the upper end of the same column 21, 21*a* is engaged with and held by the corresponding metal frame member 1 or 1*a*.

The metal frame members 41 and 41*a* are substantially the same in construction as the metal frame members 1 and 1*a*, respectively, with the exception that the metal frame members 41, 41*a* are devoid of a semicircular projection 14 having a brace anchor hole 15, and a column engagement member 13 is provided on the upper plate 2 instead of the lower plate 3.

In the metal frame members 41, 41*a*, the column engagement portions 13 of the respective upper plates 2, 2*a* are fitted with the respective lower ends of the columns 21, 21*a*. The stepped portions 11*a*, 12*a* of the respective beam engagement members 11, 12 of each metal frame member 41, 41*a* are fitted with respective ends of the two beams 42 and 43 or 42*a* and 43*a* arranged perpendicularly to each other. At the engagement portions, the beams 42, 42*a*, 43 and 43*a* are joined by welding to the engagement members 11, 12.

The metal frame members 41 and 41*a* are symmetrical in shape and can be integrally connected together in the horizontal direction by means of a bolt 24 inserted through the respective bolt holes 17, and a nut 26 tightly screwed onto the bolt 24, as shown in FIG. 3.

Figure 5:
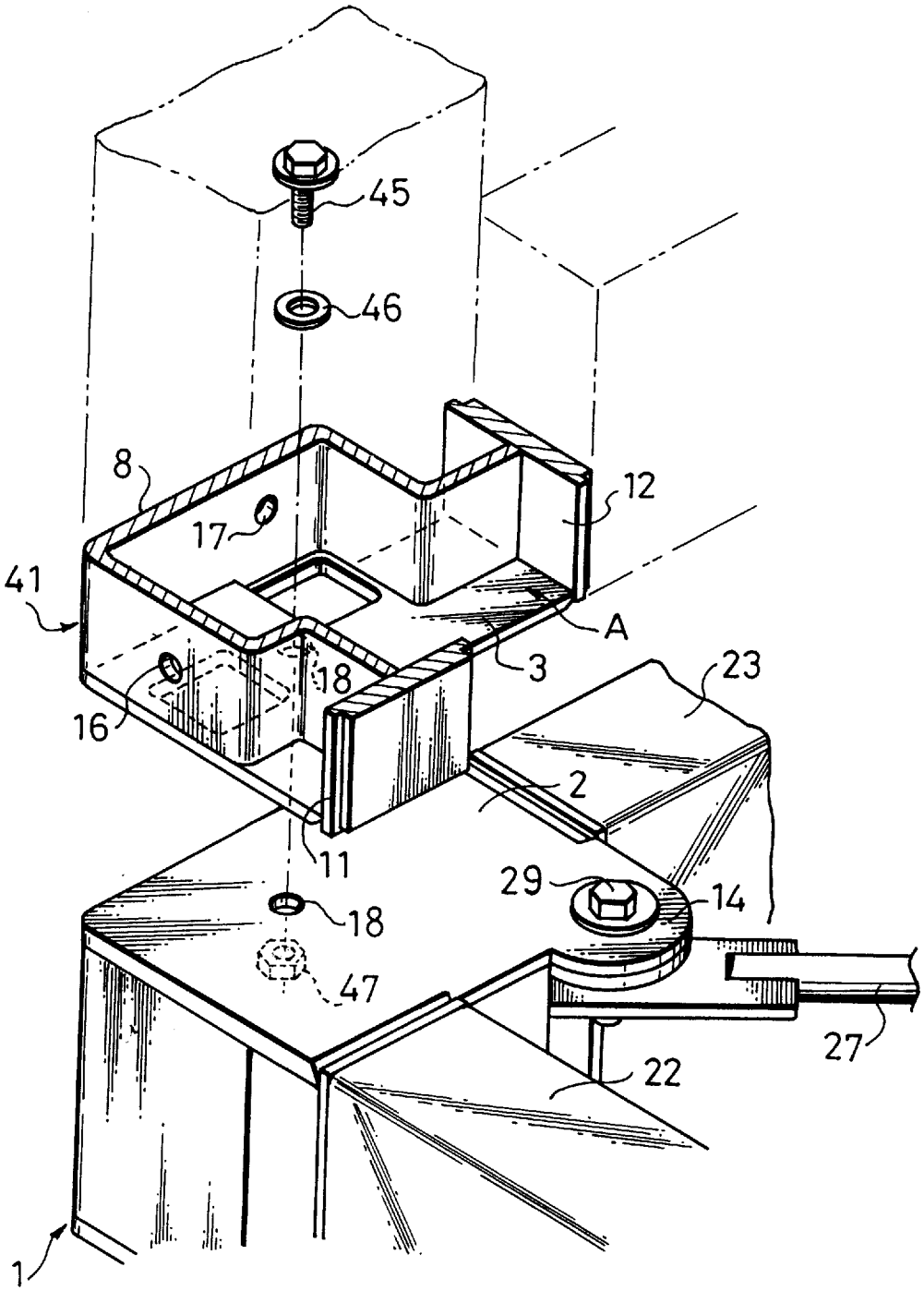
FIG. 5 is an exploded perspective view showing another form of application of the joint fitting shown in FIG. 1.

The metal frame member 41 may be directly placed on the metal frame member 1, as shown in FIG. 5, so that another block C can be constructed on the existing block C of the unit building B. Still another block C can be formed by placing the metal frame member 41*a* directly onto the metal frame member 1*a*.

After the metal frame member 41 of FIG. 3 is placed on the lower metal frame member 1 in the manner described above, a bolt 45 is inserted successively through a washer 46, a bolt hole 18 in the lower plate 3 of the upper metal frame member 41, and a bolt hole 18 in the upper plate 2 of the lower metal frame member 1, and a nut 46 is tightly screwed onto the bolt 45. Thus, the metal frame members 1 and 41 are connected together in the vertical direction.

Figure 6:
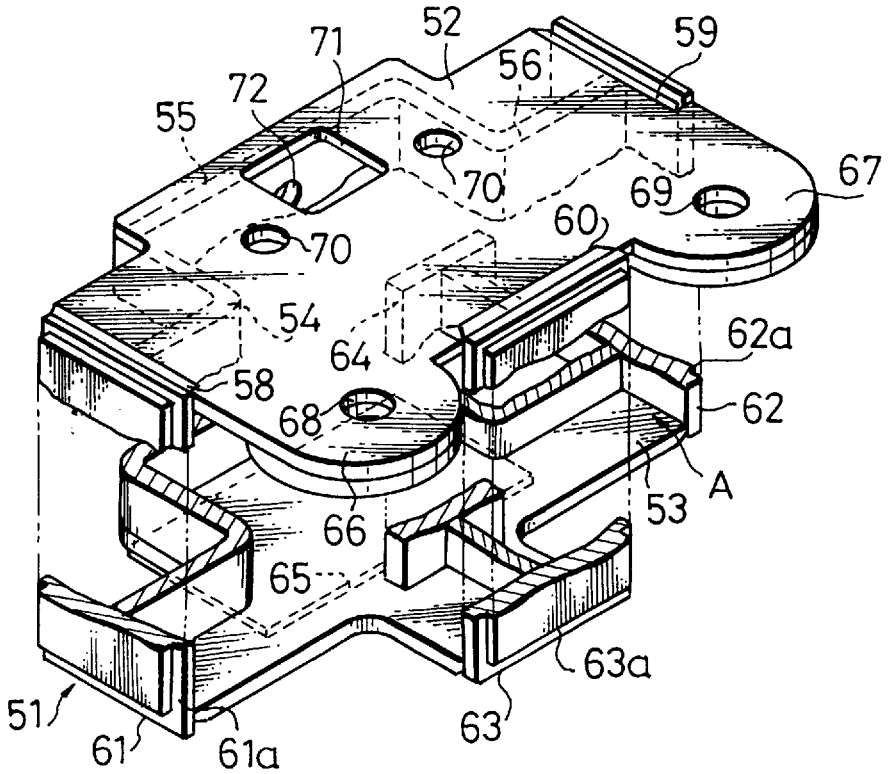
FIG. 6 is a perspective view of a joint fitting for use in a unit building according to still another embodiment of the present invention.

FIG. 6 is a perspective view, with parts cutaway for clarity, of a joint fitting according to still another embodiment of the present invention. In FIG. 6 reference numeral 51 denotes a substantially box-shaped metal frame member constituting a body of the joint fitting. The metal frame member 51 is composed of an upper plate 52 and a lower plate 53 joined together by welding and the like, with a vertical plate 54–56 and a T-shaped member 64 disposed therebetween. The vertical plate is composed of an angled strip 54, a back strip 55 and an angled strip 56.

The upper plate 52 has three recessed portions 58, 59 and 60 along its opposite side edges and a front edge (side edge extending perpendicular to the opposite side edges). Three beam engagement members 61, 62 and 63 are attached by welding to the recessed portions 58, 59, 60 and the corresponding side edges of the lower plate 53.

The beam engagement members 61, 62, 63 are each composed of a metal plate having on its outside surface, a stepped portion 61*a*, 62*a*, 63*a* composed of a single step. The stepped portions 61*a*, 62*a*, 63*a* may have a multi-step structure including a plurality of steps disposed one above another and having different outside diameters.

Each of the beam engagement members 61, 62 has an inside surface, a central portion of which is held in abutment with, and integrally joined by welding to, an edge of the corresponding angled strip 54, 56. Similarly, the beam engagement member 63 has an inside surface, a central portion of which is held in abutment with, and integrally joined by welding to, an edge of the T-shaped member 64.

Reference numeral 65 denotes a rectangular plate-like column engagement member provided on an outside surface of the lower plate 62 and is so shaped as to have an adequate shape and size to insure fittingly engagement with the upper end of a column disposed below the metal frame member 51.

Designated by 66 and 67 are a pair of laterally spaced semicircular projections projecting from the front edge (side edge) of the upper plate 52. The projections 66, 67 have a pair of brace anchor holes 68 and 69, respectively, for locking or anchoring one end of braces.

Reference numeral 70 denotes two bolt holes formed in the upper plate 52. Designated by 71 is an access hole, and numeral 72 denotes a bolt hole formed in the back strip 55. Designated by A is an access opening provided at the front side of the metal frame member 1 and available, for example, for the fastener tightening operation during the unit building assembling process.

Figure 7:
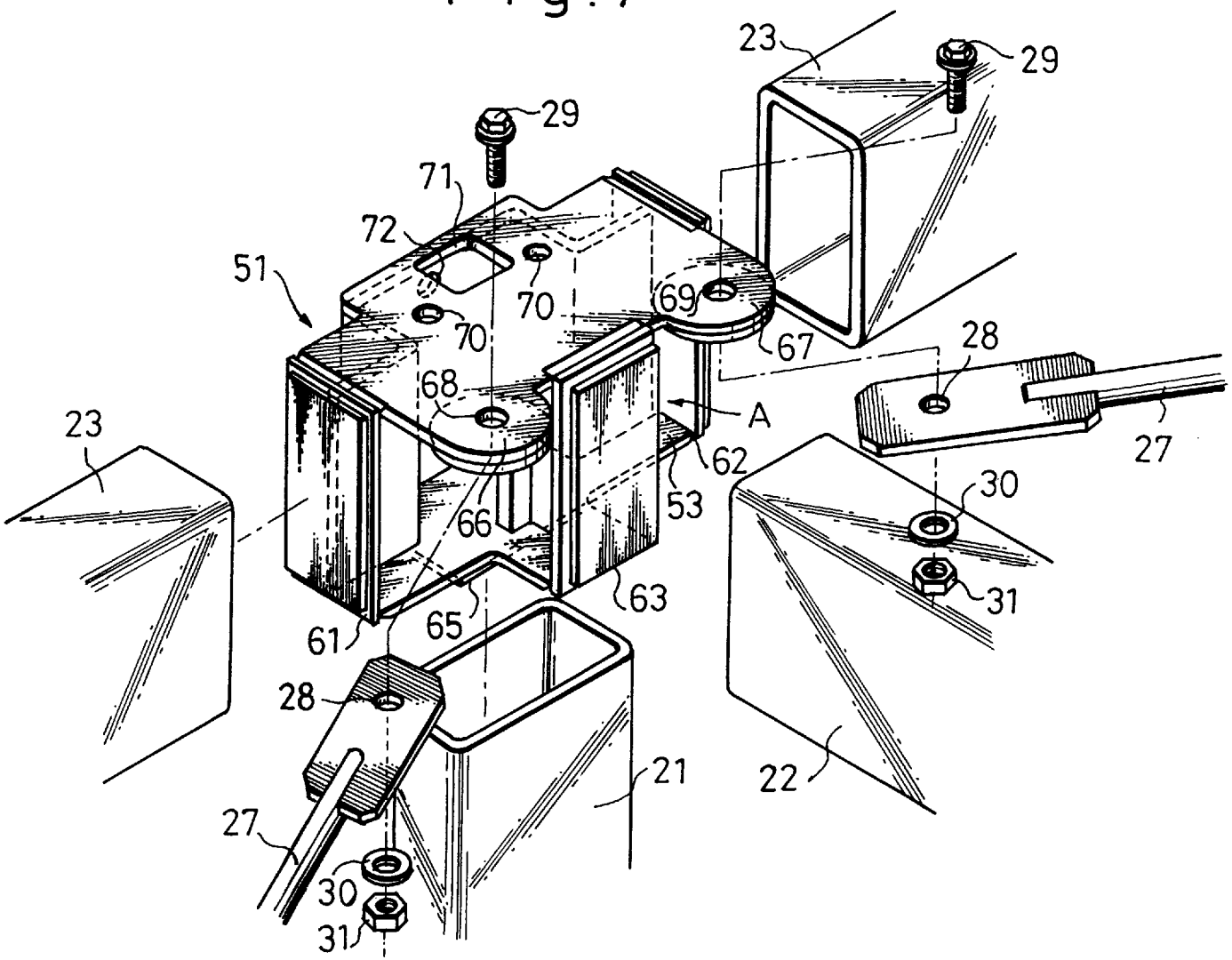
FIG. 7 is an exploded perspective view illustrative of the manner in which the joint fitting of FIG. 6 is used in practice.
Figure 8:
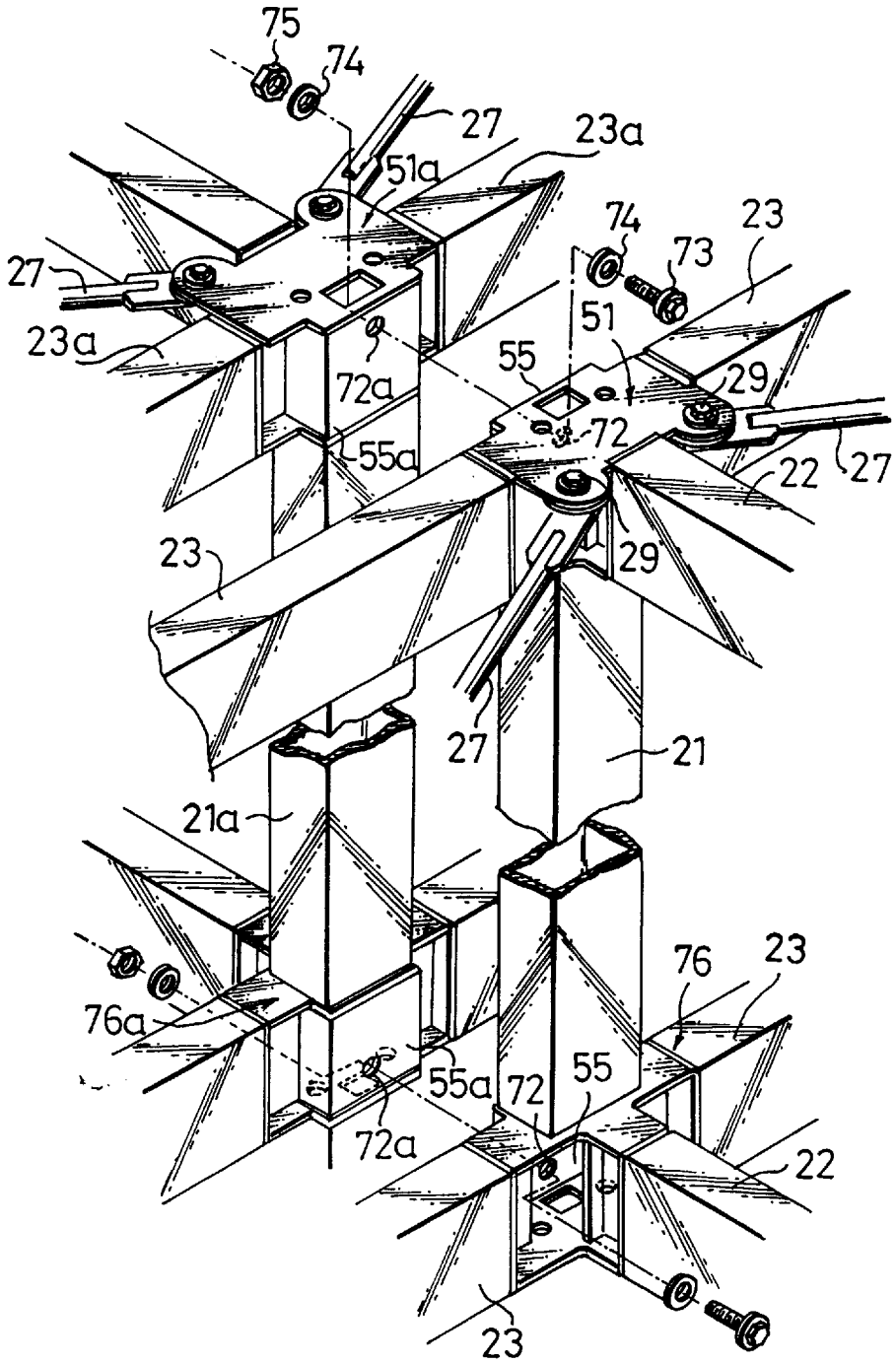
FIG. 8 is an exploded perspective view showing another form of application of the joint fitting of FIG. 6 and a joint fitting shown in FIG. 9.

In assembling a unit building B by using the metal frame member 51 of the foregoing construction, a single rectangular tube-like column 21, and three rectangular tube-like beams 22, 23, 23 are provided, as shown in FIGS. 7 and 8. An upper end of the column 21 is fitted with the column engagement member 65 on the outside surface of the lower plate 53, and one end of each of the beams 22, 23, 23 is fitted with a corresponding one of the beam engagement members 61, 62, 63.

Subsequently, the column 21 and the beams 22, 23, 23 are integrally connected or joined at respective engagement portions by welding to the column engagement member 65 and the beam engagement members 61, 62, 63, respectively.

As shown in FIG. 3, a metal frame member 51*a* which is symmetrical in shape with the metal frame member 51 is disposed at a corner of an adjacent block C of the unit building B via a beam 22.

The metal frame member 51 and the metal frame member 51*a* are disposed side by side with their back strips 55, 55*a* held in face to face confrontation, as shown in FIG. 8, and after that the two metal frame members 51 and 51*a* are directly joined together in the horizontal direction by means of a bolt 73 extending successively through a washer 74, the bolt hole 72, the bolt hole 72*a*, and a washer 74, and a nut 75 tightly screwed onto the bolt 73.

The metal frame member 51 is disposed at a joint portion between two adjacent blocks C of the unit building B. One end of each of two braces 27 is underlapped with a corresponding one of the projections 67, with its connection hole 28 vertically aligned with the brace anchor hole 69 in the projection 67. Then, a bolt 29 is inserted successively through the brace anchor hole 69, the connection hole 28 and a washer 30, and a nut 31 is tightly screwed onto the bolt 29 whereby one end of the brace 27 is connected to the corresponding projection 67 of the metal frame member 51. The same brace attaching structure is also applied to the brace anchor hole 68 in the other projection 66. Similarly, the metal frame member 51*a* and two braces 27 associated therewith can be attached in the same manner as done with respect to the metal frame member 51.

The four braces 27, as shown in FIG. 3, extend respectively between two diagonally opposed metal frame members 1 and 51*a*, between two diagonally opposed metal frame members 1*a* and 51, between two diagonally opposed metal frame members 1 and 51, and between two diagonally opposed metal frame members 1*a* and 51*a*. The braces 27 thus arranged have a function to hold the rectangular shape of two adjacent blocks C of the unit building B.

In FIG. 8 reference numerals 76 and 76*a* denote two metal frame members disposed below the metal frame members 51 and 51*a*, respectively, for holding respective lower ends of the columns 21 and 21*a* via fitting engagement provided therebetween.

Figure 9:
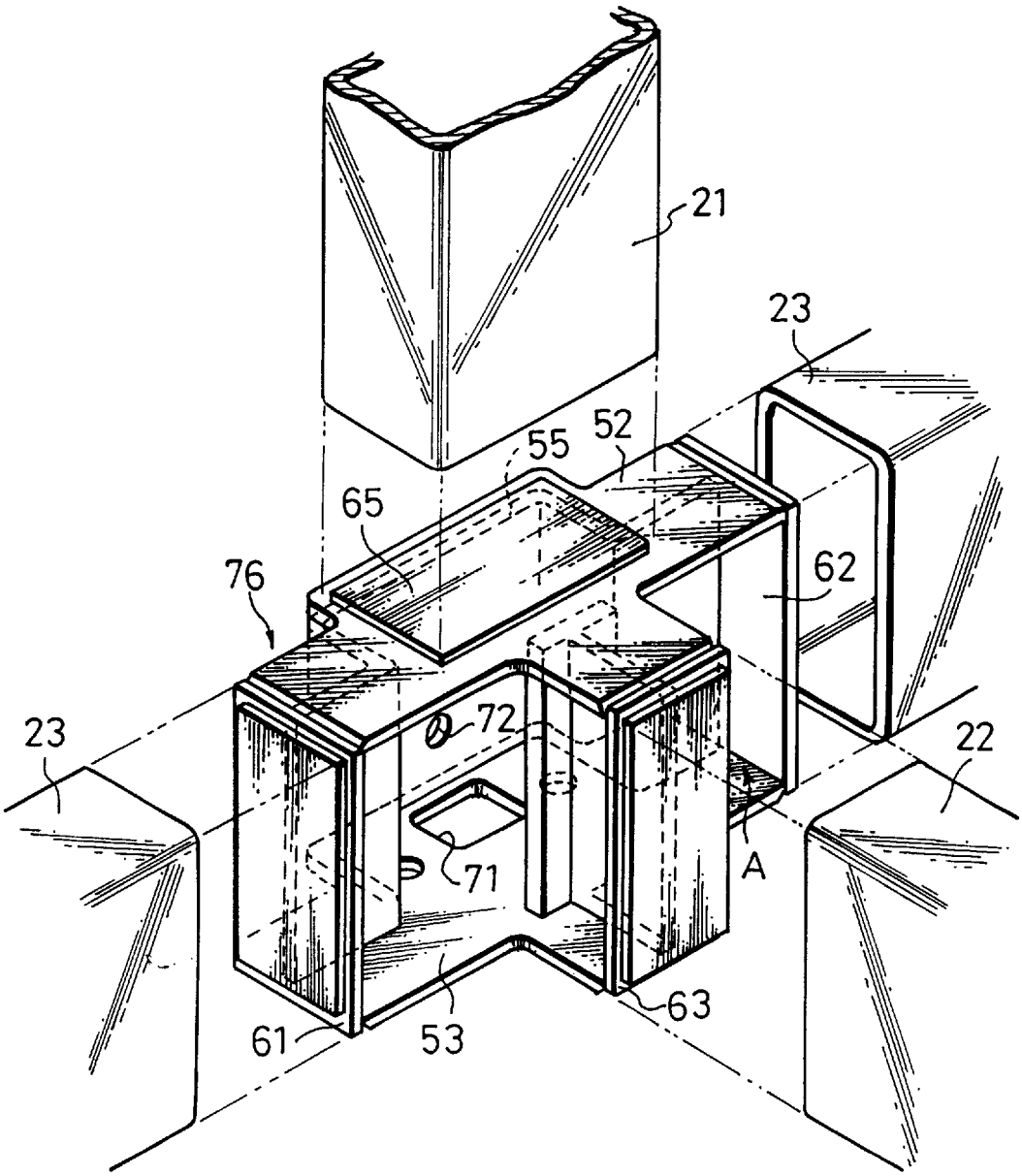
FIG. 9 is a perspective view of the joint fitting according to another embodiment of the present invention.

The metal frame member 76 shown on enlarged scale in FIG. 9 is adapted to be disposed in vertical confrontation to the metal frame member 51 of FIG. 7 and basically has substantially the same size and shape as the metal frame member 51 with the exception that the column engagement member 65 is formed on the upper plate 52 instead of the lower plate 53, and the upper plate 52 is devoid of the semicircular projections 66, 67.

In the metal frame member 76 of the foregoing construction, the column engagement portion 65 is fitted with, and subsequently joined by welding to, the lower end of a column 21 which is attached at its upper end to the upper metal frame member 51. Similarly, the beam engagement portions 61, 62 and 63 are fitted with, and joined by welding to, respective ends of the three beams 22, 23 and 23.

The metal frame member 76*a* is symmetrical in shape with the metal frame member 76 and disposed in back to back confrontation to the latter. These metal frame members 76*a* and 76 are directly connected together in the horizontal direction by means of a bolt 24 extending successively through a washer 25, a bolt hole 72 in the back strip 55, a bolt hole 72*a* in the back strip 55*a*, and a washer 25, and a nut 26 tightly screwed onto the bolt 24.

By the use of the shop-fabricated metal frame members 1, 1*a*, 41, 41*a*, 51, 51*a*, 76 and 76*a* disposed at corner portions of each individual block C or at joint portions between adjacent blocks C of a unit building B, columns 21, 21*a* and beams 22, 23 can be easily and accurately assembled together to form or define therebetween a rectangular space. The connections or joints of the columns and beams have a strength large enough to sustain a load exerted thereon during the use of the unit building. By properly placing the wall members, floor members and ceiling or roof members between the columns and beams, a unit building B having a plurality of dividable spaces can be readily erected in a short period of time.

(1) As described above, according to the respective claims of the invention, since the substantially box-shaped metal frame member of the invention includes at least one column engagement portion fittingly engageable with an end of at least one column, and at least two beam engagement portions fittingly engageable with respective ends of at least two beams, the column and the beams can be readily joined with the corresponding engagement portions. In this instance, since the respective inside peripheral surfaces of the column and beams are supported by the column and beam engagement portions, the column and the beams can be assembled easily at a low cost with an increased joint strength at the respective connections or joints. Accordingly, each individual unit block of a unit building which is composed of columns and beams can be readily constructed speedily and strongly.

(2) Furthermore, according to claim 2 and claim 3 of the invention, the beam engagement portions are disposed either on two sides of said box-shaped metal frame member facing in different directions perpendicular to each other, or alternatively on opposite sides of said box-shaped metal frame member and a side of said metal frame member facing in a direction perpendicular to said opposite sides, respectively. With this arrangement of the beam engagement portions, columns and beams used for forming corners of a block of the unit building or joint portions of two adjacent blocks can be assembled quickly with utmost ease.

(3) In addition, according to claim 4 of the invention, owing to a brace anchor hole formed in a portion of the metal frame member for anchoring one end of a brace, each pair of diagonally opposed metal frame members can be connected by a single brace with the result that the block can retain its rectangular shape in a stable manner.

(4) Furthermore, according to claim 5 of the invention, by virtue of a bolt hole formed in a portion of the metal frame member, two adjacent ones of the metal frame member can be connected together by means of a bolt extending through the bolts holes of the adjacent metal frame members and a nut tightly screwed onto the bolt. With this connection between the adjacent metal frame members, a series of blocks can be readily assembled into a large unit building.

(5) According to claim 6 of the invention, the column engagement portion and the beam engagement portions have a rectangular shape and hence are able to fit stably and reliably with a hollow rectangular column and hollow rectangular beams, respectively.

(6) In addition, according to claim 7 of the invention, since the metal frame member has an adequate number of access holes and an access opening available for receiving a tool and/or operator's fingers inside the metal frame member to join two adjacent metal frame members, a jointing work incorporating the use of a bolt-and-nut fastener can be achieved easily and speedily.

What is claimed is:

1. A joint fitting for a unit building including a plurality of unit blocks connected together in vertical, longitudinal and transverse directions and each composed of a rectangular tube-like column and at least two rectangular tube-like beams connected together, said joint fitting comprising:

a substantially box-shaped metal frame member including at least one column engagement portion fittingly engageable with an end of at least one column, and at least two beam engagement portions fittingly engageable with respective ends of at least two beams to form an angular arrangement between said box-shaped two beams, said metal frame member has a jointly formed upper plate, a lower plate, and a vertical plate disposed between said upper and lower plates, each of said upper plate and said vertical plate having at least one bolt hole, said upper plate further having at least one access opening available during the assembling process of the unit building, and said upper and lower plates defining therebetween another access opening located at a corner of said angular arrangement and available during the assembling process of the unit building.

2. A joint fitting according to claim 1, wherein said beam engagement portions are disposed on two sides of said box-shaped metal frame member facing in different directions perpendicular to each other.

3. A joint fitting according to claim 1, wherein the number of said beam engagement portions is three, and three said beam engagement portions are disposed on opposite sides of said box-shaped metal frame member and a side of said metal frame member facing in a direction perpendicular to said opposite sides, respectively.

4. A joint fitting according to claim 1, wherein said metal frame member includes a portion having a brace anchor hole for anchoring one end of a brace to said metal frame member.

5. A joint member according to claim 1, wherein said metal frame member includes a portion having a bolt hole for joining two adjacent ones of said metal frame member.

6. A joint member according to claim 1, wherein said column engagement portion is composed of a rectangular metal plate, and said beam engagement portions are each composed of a rectangular metal plate and one or more rectangular stepped portions formed on an outside surface of said rectangular metal plate.

7. A joint fitting in accordance with claim 1, wherein:

each of said engagement portions include a stepped portion having a shape to be fitted into an end of one of the tube-like beams and welded to a corresponding tube-like member.

8. A joint fitting for a plurality of rectangular tube-like members, the joint fitting comprising:

a box-shaped frame member including a first and second plate substantially parallel to each other and spaced from each other, said frame member including a joining plate joining said first and second plates together, said first plate and said joining plate each defining a bolt hole, said first plate defining an access opening for fastening, from an inside of said box shaped frame, a bolt passed through said bolt hole;

three engagement portions connected to said frame member and each connectable to one of the tube-like members, two of said engagement portions connectable to the tube-like members in an angular arrangement of the tube-like members to each other, said two engagement portions and said first and second plates defining another access opening in a corner of said angular arrangement for fastening, from said inside of said box shaped frame, a bolt passed through said bolt hole.

9. A joint fitting in accordance with claim 8, wherein:

each of said engagement portions include a stepped portion having a shape to be fitted into an end of one of the tube-like members and welded to a corresponding tube-like member.

* * * * *

UNITED STATES PATENT AND TRADEMARK OFFICE

CERTIFICATE OF CORRECTION

PATENT NO. : 5,816,011

DATED : October 6, 1998

INVENTOR(S) : Kikuzo KURAMOTO

It is certified that error appears in the above-indentified patent and that said Letters Patent is hereby corrected as shown below:

On the title page, item

[75] Inventor: Kikuzo KURAMOTO, Chiba, Japan

Signed and Sealed this

Fifth Day of January, 1999

*Attest:*

*Attesting Officer*

*Acting Commissioner of Patents and Trademarks*